US007963340B2

(12) United States Patent
Gramstad et al.

(10) Patent No.: US 7,963,340 B2
(45) **Date of Patent: *Jun. 21, 2011**

(54) METHOD FOR DISINTEGRATING A BARRIER IN A WELL ISOLATION DEVICE

(75) Inventors: Bernt Gramstad, Aalgaard (NO); Terje Baustad, Stavanger (NO); Tarald Gudmestad, Naerbo (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/390,001

(22) Filed: Feb. 20, 2009

(65) Prior Publication Data

US 2009/0151958 A1 Jun. 18, 2009

Related U.S. Application Data

(63) Continuation of application No. 11/380,816, filed on Apr. 28, 2006, now Pat. No. 7,513,311.

(51) Int. Cl.
*E21B 29/00* (2006.01)

(52) U.S. Cl. ..... 166/376

(58) Field of Classification Search ..... 166/250.08, 166/377, 376, 317; 277/336
See application file for complete search history.

(56) References Cited

U.S. PATENT DOCUMENTS

| | | | | |
|---|---|---|---|---|
| 3,533,241 | A | 10/1970 | Bowerman et al. | |
| 3,702,537 | A | 11/1972 | Landers | |
| 3,831,680 | A | 8/1974 | Edwards et al. | |
| 3,967,679 | A | 7/1976 | Liljestrand | |
| 4,691,775 | A | 9/1987 | Lustig et al. | |
| 4,846,272 | A | 7/1989 | Leggett | |
| 5,479,986 | A * | 1/1996 | Gano et al. | 166/292 |
| 5,765,641 | A * | 6/1998 | Shy et al. | 166/292 |
| 5,924,696 | A | 7/1999 | Frazier | |
| 5,947,204 | A | 9/1999 | Barton | |
| 5,947,205 | A | 9/1999 | Shy | |
| 5,954,135 | A * | 9/1999 | Williamson et al. | 166/382 |

(Continued)

FOREIGN PATENT DOCUMENTS

| | | |
|---|---|---|
| EP | 0 681 087 A3 | 2/1997 |
| GB | 2 245 913 A | 1/1992 |
| GB | 2 437 657 A | 10/2007 |

OTHER PUBLICATIONS

UK Search Report dated Jul. 27, 2007 received in corresponding application No. GB0708279.5.

(Continued)

*Primary Examiner* — Kenneth Thompson
*Assistant Examiner* — James G Sayre
(74) *Attorney, Agent, or Firm* — Wong, Cabello, Lutsch, Rutherford & Brucculeri, LLP

(57) ABSTRACT

Disclosed herein is a temporary well isolation device, which is sealingly disposable in downhole tubing, and which has a housing with an axial passage. The temporary well isolation device also has frangible barrier element within the housing, where the frangible barrier element is sealingly engaged in the passage blocking fluid flow through the passage. The frangible barrier element bears a load from fluid pressure. The temporary well isolation device also has a disengageable constraint in contact with a frangible barrier element so as to redirect the load on the frangible barrier element from a first component of the load to a second component of the load, thereby preventing rupture of the frangible barrier element. Also disclosed herein is a method for disintegrating a frangible barrier element disposed in a passage of a temporary well isolation device.

26 Claims, 6 Drawing Sheets

U.S. PATENT DOCUMENTS

| | | | | |
|---|---|---|---|---|
| 5,996,696 | A | 12/1999 | Jeffree et al. | |
| 6,026,903 | A | 2/2000 | Shy et al. | |
| 6,076,600 | A * | 6/2000 | Vick et al. | 166/192 |
| 6,161,622 | A | 12/2000 | Robb et al. | |
| 6,182,704 | B1 | 2/2001 | Bevacco | |
| 6,431,276 | B1 | 8/2002 | Robb et al. | |
| 6,450,263 | B1 * | 9/2002 | Schwendemann | 166/373 |
| 6,472,068 | B1 * | 10/2002 | Glass et al. | 428/410 |
| 6,966,368 | B2 | 11/2005 | Farquhar | |
| 7,513,311 | B2 * | 4/2009 | Gramstad et al. | 166/376 |
| 2002/0108750 | A1 | 8/2002 | Friend et al. | |
| 2007/0039741 | A1 * | 2/2007 | Hailey, Jr. | 166/376 |
| 2008/0066923 | A1 * | 3/2008 | Xu | 166/376 |

OTHER PUBLICATIONS

Magnum Oil Tools International, LLC Magnum Disk Tool Brochure at: http://www.magnumoiltools.com/MAGNUMDISKBROCHURE02-22-06.pdf.

Magnumdisk "Single Magnumdisk" "No Debris" Tubing Plug sales brochure MAGNUM International, Inc. 5353 County Road 73, Robstown, TX 78380.

Magnumdisk "Dual Magnumdisk" "No Debris" Tubing Plug sales brochure MAGNUM International, Inc. 5353 County Road 73, Robstown, TX 78380.

* cited by examiner

METHOD FOR DISINTEGRATING A BARRIER IN A WELL ISOLATION DEVICE

RELATED APPLICATION

This application is a continuation application and claims priority to a utility patent application Ser. No. 11/380,816, filed on Apr. 28, 2006, with the same title, by the same inventor, assigned to the same assignee, which is hereby incorporated by reference in its' entirety.

FIELD OF THE INVENTION

The invention relates to oilfield tools, and more specifically to methods and devices for temporary well zone isolation. In particular, the invention relates to temporary well zone isolation devices with frangible barrier elements and methods for the disintegration of frangible barrier elements.

BACKGROUND OF THE INVENTION

In a production well, a production string composed of the production tubing and other completion components is used to transport production fluid containing hydrocarbons from a downhole formation to the surface of the well. This production tubing is typically pressure tested to insure that no leaks will form under the pressure of actual production. It is desirable to find leaks before production fluid is introduced into the tubing because of the gross inefficiencies of post-production repair. Typically, a temporary well barrier, or temporary plug, is used to seal off a particular segment of the production tubing, or well zone, for pressure testing. Often, the well zone consists of essentially the entire well. Fluid is then introduced above the temporary well barrier and pressurized to detect leaks. After testing, the temporary well barrier must be removed from the production string.

Several types of well isolation devices using temporary well barriers exist in the prior art, including the Model E Hydro Trip pressure sub by Baker Oil Tools, the OCRE Full Bore Isolation Valve and Multi-Cycle Tool by Baker Oil Tools, and the Mirage Disappearing Plug from Halliburton. While some well isolation devices use valves to control well flow, it is often desirable that once the temporary well barrier is removed, substantially the full inner diameter of the production tubing is restored. One type of temporary well barriers typical of the prior art include solid barriers held in place by a support assembly. To remove the barrier, the support assembly is retracted or sheared off to allow the solid barrier to drop through the wellbore. Designs relying on gravity for removal of the plug, however, have limited applications in substantially horizontal wells.

To extend well-isolation to horizontal wells, plugs were developed that provide a large bore in the well isolation device after removal of the temporary well barrier without dropping the temporary barrier into the wellbore. These plugs are broadly referred to as disappearing plugs. One type of disappearing plug operates by recessing the temporary well barrier into the housing of the well isolation device. One disappearing plug from Baker Oil Tools, for example, recesses a flapper into the tool where it is isolated from the production flow path.

Other disappearing plugs operate by disintegrating a frangible well barrier, typically by impacting the barrier or setting off an explosive charge. Total Catcher Offshore AS in Bergen has developed several well isolation devices employing this type of plug, such as the Tubing Disappearing Plug (TDP), the Tubing Disappearing Smart Plug (TDSP), and the Intervention Disappearing Smart Plug (IDSP).

U.S. Pat. No. 6,026,903 by Shy et al. describes a bidirectional disappearing plug which is capable of selectively blocking flow through a flowbore of a tubing string disposed within a subterranean well. The plug may subsequently be disposed of, leaving little or no restriction to flow through the flowbore, and leaving no significant debris in the flowbore by causing a rupture sleeve to penetrate the plug member and destroy the plug's integrity.

The aforementioned disappearing plugs currently in use, while an improvement over previous technology, are less than ideal because they lack reliability, especially in environments where wells deviate from vertical.

SUMMARY OF THE INVENTION

Disclosed herein is a temporary well isolation device. The temporary well isolation device has a housing that is sealingly disposable in downhole tubing. The housing has an axial passage through the downhole tubing, where a first end of the passage is in fluid communication with the downhole tubing above the housing and a second end of the passage is in fluid communication with the downhole tubing below the housing.

The temporary well isolation device also has frangible barrier element within the housing, where the frangible barrier element is sealingly engaged in the passage blocking fluid flow through the passage. The frangible barrier element bears a load from fluid pressure. The temporary well isolation device also has a disengageable constraint in contact with the frangible barrier element so as to redirect the load on the frangible barrier element from a first component of the load to a second component of the load, thereby preventing rupture of the frangible barrier element.

Some embodiments of the temporary well isolation device have a pump for increasing the pressure above the frangible barrier element to rupture the frangible barrier element. In some embodiments, the first component of the load is the tensile component and the second component of the load is the compressive component. The shape of the frangible barrier element may be such that the load on the frangible barrier element having the constraint disposed thereabout is substantially compressive and the load on the frangible barrier element upon the constraint upon the constraint being disengaged is substantially tensile.

Also disclosed herein is a method for disintegrating a frangible barrier element disposed in a passage of a temporary well isolation device where the frangible barrier element blocks fluid flow through the passage and thereby supports a load from fluid pressure. The method includes facilitating rupture of the frangible barrier element from a first component of the load by structurally increasing the ratio of the first component of the load to a second component of the load. In some embodiments, the method may also include increasing the fluid pressure above the frangible barrier element. In some embodiments, the first component of the load is the compressive component and the second component of the load is the tensile component. Structurally increasing the ratio of the first component of the load to the second component of the load further may include disengaging a constraint.

DETAILED DESCRIPTION OF THE INVENTION

Figure 1A:
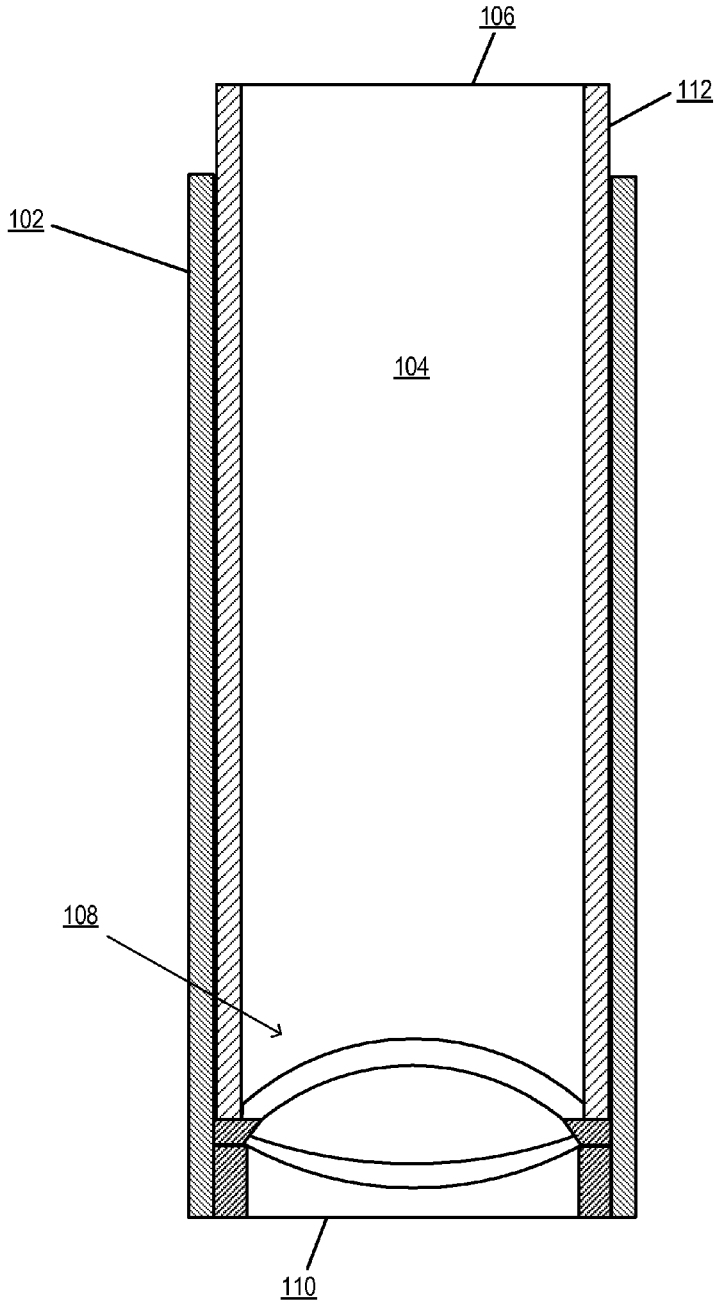
FIG. 1A illustrates a temporary well isolation device according to certain teachings of the present disclosure before triggering.
Figure 1B:
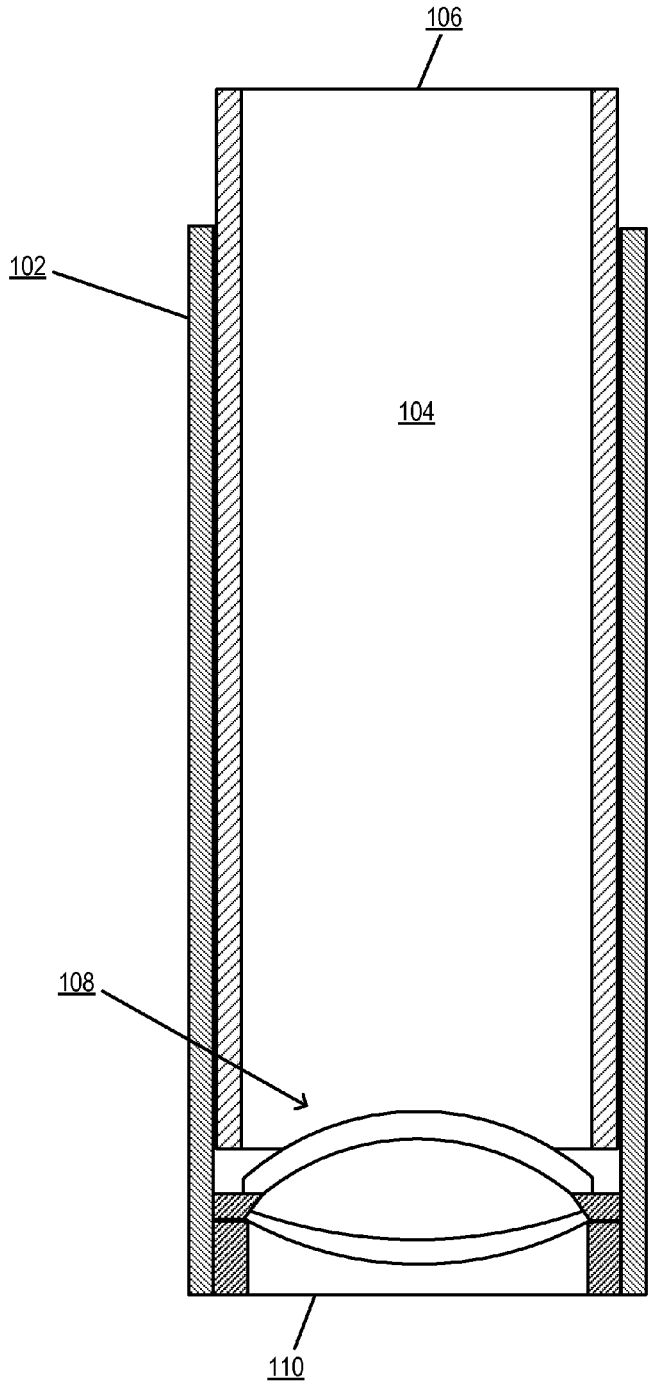
FIG. 1B illustrates further aspects of a temporary well isolation device according to certain teachings of the present disclosure upon triggering.

Exemplary devices for temporary well isolation with frangible barrier elements and exemplary methods for the disintegration of frangible barrier elements according to embodiments of the present invention are described with reference to the accompanying drawings, beginning with FIGS. 1A and 1B. FIG. 1A illustrates a temporary well isolation device according to the present invention before triggering. FIG. 1B illustrates a temporary well isolation device according to the present invention upon triggering. The temporary well isolation device operates generally to temporarily seal off a particular segment of the production tubing, or well zone, until being triggered.

The structural differences in FIG. 1A and FIG. 1B consist of the state of disengagement of the disengageable constraint due to triggering of the device. Upon being triggered, the temporary well isolation device causes the rupture and disintegration of a frangible barrier element. The temporary well isolation device is preferably an ISO 14310-V0 qualified barrier for use in High Pressure High Temperature horizontal wells. Although the present embodiment operates to seal off production tubing, in other embodiments, the temporary well isolation device may operate to temporarily seal off other types of downhole tubing as will occur to those of skill in the art.

The temporary well isolation device of FIGS. 1A and 1B includes a housing (102) sealingly disposable in downhole tubing (not shown). The housing (102) has an axial passage (104) with a first (106) end in fluid communication with the downhole tubing above the housing (102) and a second end (110) in fluid communication with the downhole tubing below the housing (102). In the following description, directional terms, such as "above", "below", "upper", "lower", and so on, are used for convenience in referring to the accompanying drawings. Readers of skill in the art will recognize that such directional language refers to locations in downhole tubing either closer or further away from surface and that the various embodiments of the present invention described herein may be utilized in various orientations; such as inclined, inverted, horizontal, vertical; without departing from the principles of the present invention. Although the housing of FIGS. 1A and 1B is substantially tubular, other configurations could also be used, such as, for example, an irregular cylinder or a substantially ovular shape.

The temporary well isolation device also features a frangible barrier element (108) within the housing (102). The frangible barrier element (108) is sealingly engaged in the passage (104) blocking fluid flow through the passage (104), which results in the frangible barrier element (108) bearing a load from fluid pressure. The frangible barrier element (108) of FIGS. 1A and 1B is made up of two lens-shaped discs attached to opposite sides of a metallic ring in order to form a larger disc, which may be solid or hollow. Although a metallic ring is disclosed here, this ring could also be made of ceramic material, polymers, plastics, composite material, or any other material as will occur to those of skill in the art. The frangible barrier element could alternately be made of a single disc or three or more discs, and could, in some instances, be substantially flat instead of lens-shaped. Further aspects of the frangible barrier element are described in more detail with reference to FIG. 3 below.

The temporary well isolation device also includes a disengageable constraint disposed about the frangible barrier element (108) so as to redirect the load on the frangible barrier element (108) by joining with the frangible barrier element (108) to form a compression-loaded structure. The disengageable constraint of FIGS. 1A and 1B is a movable sleeve (112) which supports the circumferential edge of the frangible barrier element (108). By redirecting the load on the frangible barrier element (108), the movable sleeve (112) supporting the edges of the frangible barrier element (108) prevents rupture of the frangible barrier element (108). Although the disengageable constraint as described herein is a movable sleeve, other disengageable constraints could be used, such as, for example, a removable or releasable ring, a destructible ring, a cable, a collet, a dog, or any other disengageable constraint which may be in contact with the frangible barrier element as will occur to those of skill in the art.

While the movable sleeve (112) remains engaged, the frangible barrier element (108) bears a load that is primarily compressive. Upon the movable sleeve (112) being disengaged, the frangible barrier element (108) bears a load that is primarily tensile. This change in the load facilitates rupture of the frangible barrier element. Although the movable sleeve (112) as disclosed above converts a primarily tensile load on the frangible barrier element to a primarily compressive load, any disengageable constraint could be used which facilitates rupture of the frangible barrier element by redirecting the load on the frangible barrier element from a first component of the load to a different component of the load.

Disengaging the movable sleeve (112) is carried out by moving the movable sleeve (112) axially up the housing. As discussed above, many disengageable constraints may be used in practicing certain teachings of the present disclosure. Disengaging the disengageable constraint, therefore, may be carried out by removing at least a portion of the constraint, which includes separating the frangible barrier element and at least a portion of the constraint. Separating the frangible barrier element and a portion of the constraint may include, for example, moving the constraint axially, moving the frangible barrier element axially, moving the constraint radially, and moving the frangible barrier element radially. Removing at least a portion of the constraint may also include dissolving or shearing the constraint.

Disengaging the movable sleeve (112) may further be carried out by a triggering mechanism and a disengaging mechanism which separates the frangible barrier element and at least a portion of the disengageable constraint. This disengaging mechanism typically is a set of components to physically separate the frangible barrier element and at least a portion of the disengageable constraint inside the housing. Alternatively the triggering mechanism is a set of components which actuates the disengaging mechanism.

The moveable sleeve (112) is moved axially by a disengaging mechanism, such as, for example a hydraulic piston, which has been triggered by a triggering mechanism, such as, for example a wireline, a slickline, or a preset electronic timer. Although a wireline activated lift and latch configuration (not shown) is preferable, readers of skill in the art will recognize that many types of triggering mechanisms and disengaging mechanisms maybe coupled to move the moveable sleeve. Examples of useful configurations include, for example, a mechanical-wireline configuration, a wireline activation-pulling tool configuration, a hydraulic cycling trigger configuration, and an electro-hydraulic wireline tool with anchor/stroke function configuration. In other embodiments, these triggering mechanisms and disengaging mechanisms may be coupled to move other types of disengageable constraints, as discussed above. The listed triggering mechanisms and disengaging mechanisms are well known in the prior art.

Figure 2A:
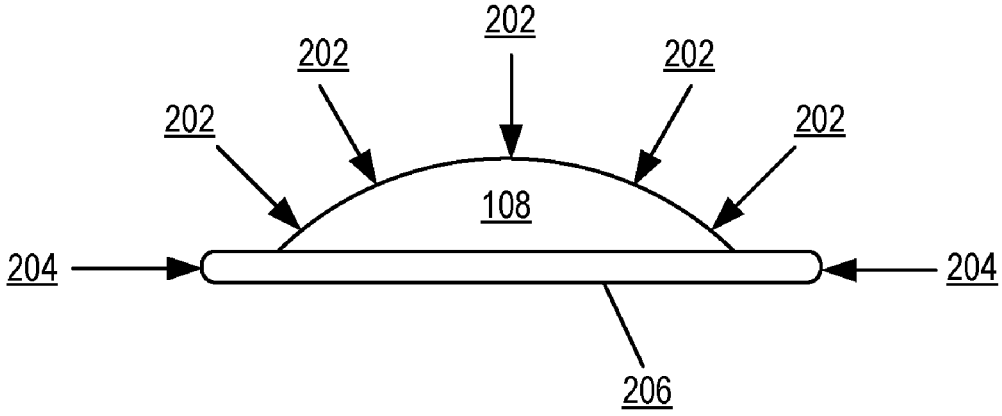
FIG. 2A illustrates the loads and stresses on the frangible barrier element for use in a temporary well isolation device according to certain teachings of the present disclosure wherein the disengageable constraint is engaged.
Figure 2B:
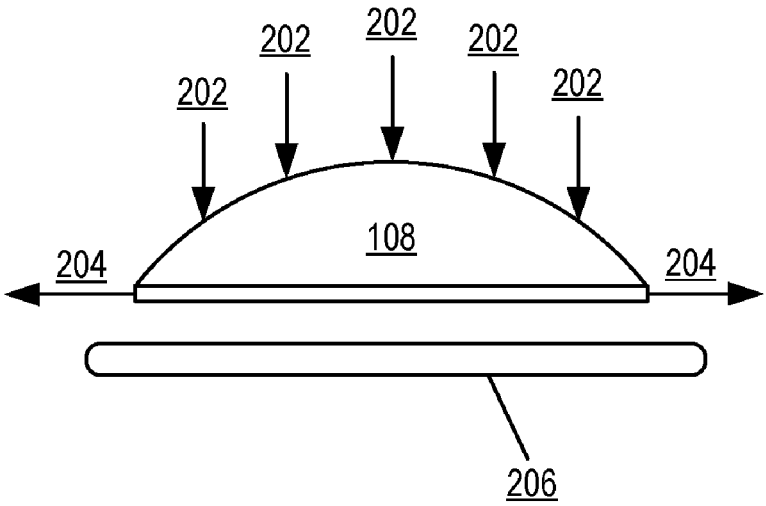
FIG. 2B illustrates the loads and stresses on the frangible barrier element for use in a temporary well isolation device according to certain teachings of the present disclosure wherein the disengageable constraint is disengaged.

As previously discussed, the temporary well isolation device includes a disengageable constraint (206) disposed about the frangible barrier element (108) so as to redirect the load (202) on the frangible barrier element (108) by joining with the frangible barrier element (108) to support (204) the frangible barrier element (108) by forming a compression-loaded structure. FIG. 2A sets forth the loads (202) and stresses on the frangible barrier element (108) for use in a temporary well isolation device according to the present invention wherein the disengageable constraint (206) is engaged. FIG. 2B sets forth the loads and stresses on the frangible barrier element (108) for use in a temporary well isolation device according to the present invention wherein the movable sleeve (112) is disengaged.

In the temporary well isolation device, the first component of the load is the tensile component and the second component of the load is the compressive component. In FIG. 2A, the shape of the frangible barrier element (108) is such that the load (202) on the frangible barrier element (108) having the disengageable constraint (206) disposed thereabout is substantially compressive. Turning now to FIG. 2B, in the temporary well isolation device as configured in FIG. 1B, the shape of the frangible barrier element (108) is such that the load (212) on the frangible barrier element (108) upon the disengageable constraint (20) being disengaged is substantially tensile. Thus, after trigging, the change in support geometry causes internal stress in the frangible barrier element to shift from compressive to tensile when pressure is increased above barrier.

In the embodiment of the present invention as shown in FIGS. 2A and 2B, the frangible barrier element (108) is substantially hemispherical, but frangible barrier elements of other geometries such that the component forces of the load born by the frangible barrier element are altered upon the disengageable constraint being disengaged are also contemplated.

As shown in FIGS. 2A and 2B, by varying the boundary conditions on a hemispherical cap under pressure from the convex side from fixed boundary conditions to free boundary conditions, the loads, and, therefore, the stresses, on the hemispherical cap shift from being primarily compressive to primarily tensile. In embodiments of the present invention, therefore, the frangible barrier element made of a material with a difference in compressive and tensile strength may be ruptured by changing the boundary conditions.

Figure 3:
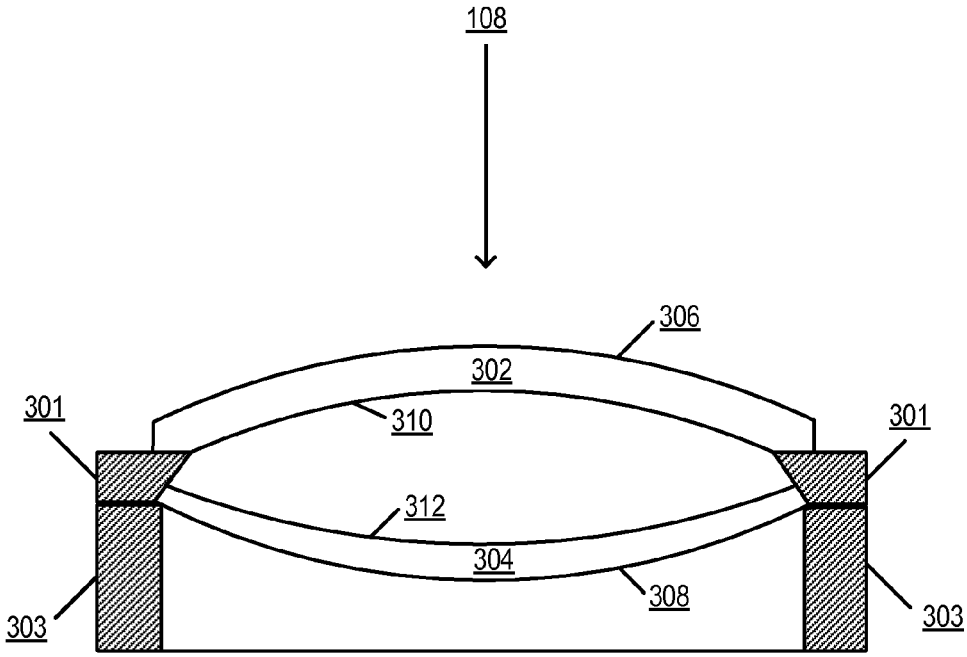
FIG. 3 illustrates a detailed view of an embodiment of a frangible barrier element according to certain teachings of the present disclosure.

FIG. 3 illustrates an exemplary frangible barrier element (108). The frangible barrier element (108) comprises two discs, with each disc having two sides and a circumferential edge. The embodiment of FIG. 3 is composed of two discs (302, 304), with each disc having a convex side (306, 308) and a concave side (310, 312), an annular disc holder (301), and an annular disc holder body (303). The first disc (304) is bracketed between the disc holder (301) and the disc holder body (303), where it is sealingly attached to the disc holder (301), preferably by vulcanizing or molding. The seal created from vulcanizing or molding the first disc (304) to the disc holder is preferably capable of withstanding pressures of up to 7,500 PSI. The disc holder (301) and the disc holder body (303) are welded together.

The second disc (302) is vulcanized or molded to the disc holder (301) opposite the first disc (304) with the second disc's concave side (310) facing the first disc's concave side (312), so that the interior of the disc holder (301) is sealed. The seal created from vulcanizing or molding the second disc (302) to the disc holder (301) is preferably capable of withstanding pressures of up to 10,000 PSI. As assembled, the two disks and the disc holder form a larger, hollow disc. Either or both of the discs may be scored or etched on one or more sides, to control fragment size and geometry. Alternatively, the discs may be molded with a geometry conducive to controlling fragment size, such as, for example, the "pineapple" geometry used in military hand grenades. Both scoring the disc surface and changing the molded surface geometry of the disc may also be used to facilitate fragmentation. Although a two-piece frangible barrier element (108) is described above, the frangible barrier element (108) may be more than two pieces, or a single piece.

The frangible barrier element (108) illustrated in FIG. 3 is preferably composed of a material capable of withstanding a higher compressive load than a tensile load. This material may be ceramic, metal, or polymer. The material may also be a composite of two or more materials. In particular embodiments, the ratio of compressive strength to tensile strength of at least one of the materials is approximately 6:1. This material may be an Aluminum Oxide (Alumina) ceramic. It may also be desirable that the fragments of the frangible barrier element be transported up the tubing to surface. In such embodiments, the materials of which the frangible barrier element is composed should be of a type that the fragments are non-harmful and non-obstructive to other equipment in the pipe.

As discussed above, the disengageable constraint may be a moveable sleeve which is disengaged by moving the moveable sleeve axially. In alternate embodiments, however, separation of the housing includes an axially movable tubular sleeve wherein is mounted the frangible barrier element, so that the frangible barrier element may be axially separated from the disengageable constraint. The operation of such a configuration is substantially identical to the disengageable constraint composed of an axially moveable tubular sleeve as discussed above.

Figure 4A:
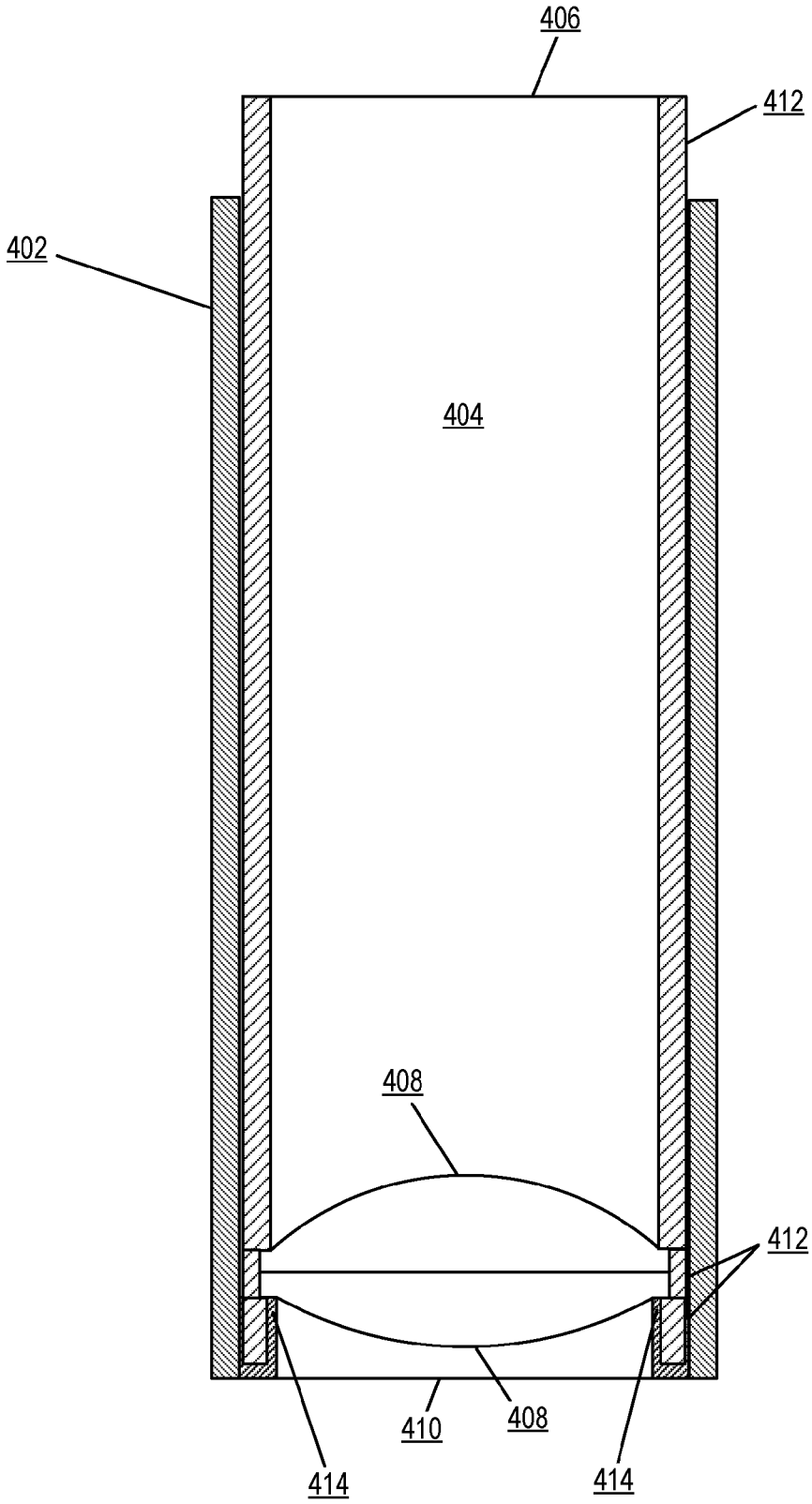
FIG. 4A illustrates an alternate temporary well isolation device according to the present invention before triggering.
Figure 4B:
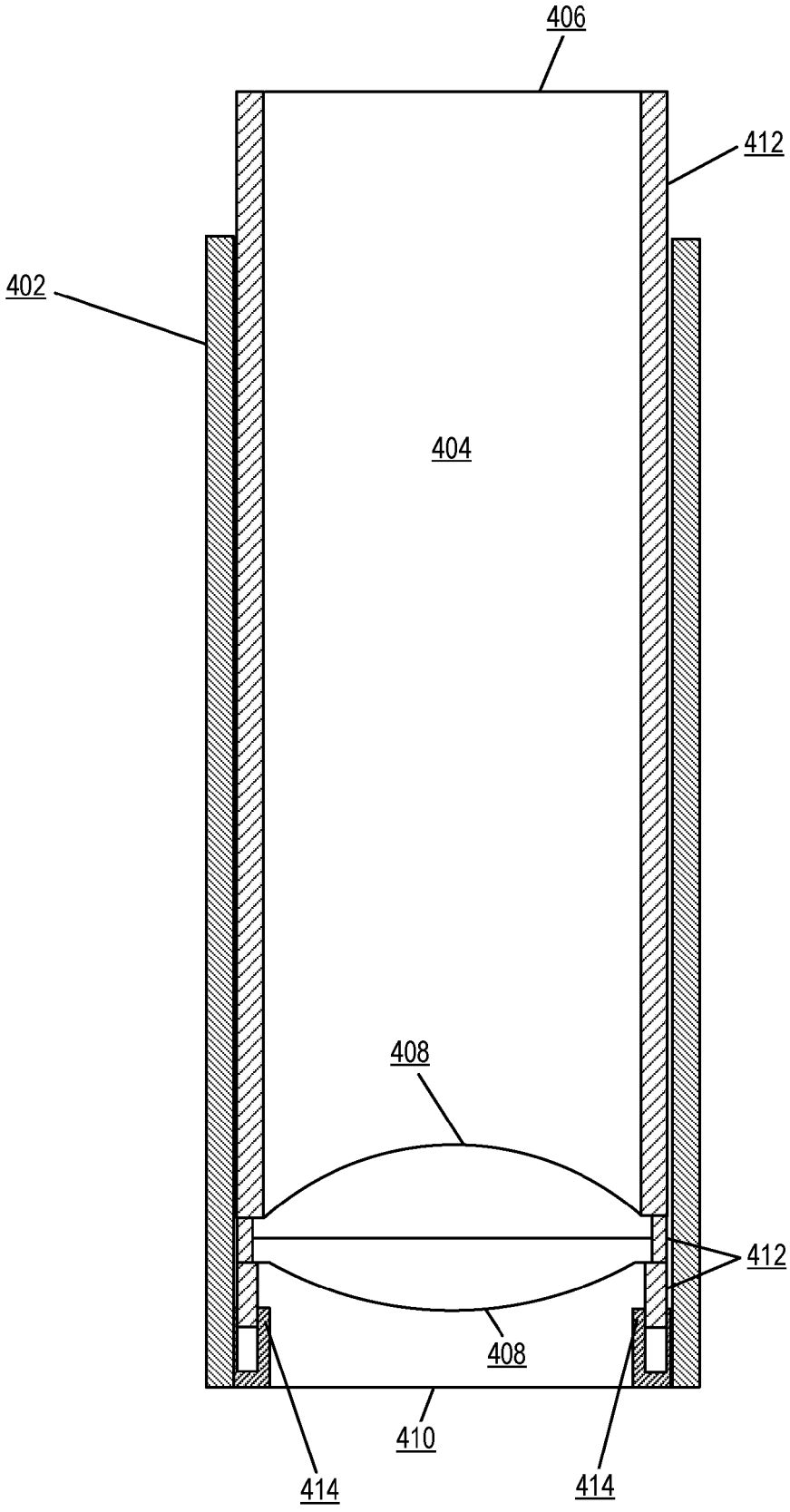
FIG. 4B illustrates an alternate temporary well isolation device according to the present invention upon triggering.

For further explanation, therefore, FIG. 4A illustrates an alternate temporary well isolation device according to the present invention before triggering. FIG. 4B illustrates an alternate temporary well isolation device according to the present invention upon triggering. The structural differences in FIG. 4A and FIG. 4B consist of the state of disengagement of the disengageable constraint due to triggering of the device.

The temporary well isolation device of FIGS. 4A and 4B includes a housing (402) sealingly disposable in downhole tubing (not shown). The housing (402) has an axial passage (404) with a first end (406) in fluid communication with the downhole tubing above the housing (402) and a second end (410) in fluid communication with the downhole tubing below the housing (402). Although the housing of FIGS. 4A and 4B is substantially tubular, other configurations could also be used, such as, for example, an irregular cylinder or a substantially ovular shape.

The temporary well isolation device of FIGS. 4A and 4B includes an axially movable tubular sleeve (412) wherein is mounted a frangible barrier element (408), so that the frangible barrier element (408) may be axially separated from the disengageable constraint (414). In FIG. 4A, the frangible barrier element (408) is sealingly engaged in the passage (404) blocking fluid flow through the passage (404), which results in the frangible barrier element (408) bearing a load from fluid pressure. The frangible barrier element (408) of FIGS. 4A and 4B is made up of two lens-shaped discs, with each disk having a flat side and a convex side. These two lens-shaped discs are proximate to each other with the flat sides being adjacent to each other forming a larger solid disc. The frangible barrier element (408) could alternately be made of a single disc or three or more discs.

Disengaging the disengageable constraint (414) of FIG. 4A is carried out by moving the movable sleeve (412), and, therefore, the frangible barrier element (408), axially up the housing away from the disengageable constraint (414). As in the case of the moveable sleeve of FIGS. 1A and 1B above, moving the movable sleeve (412) may further be carried out by a triggering mechanism and a disengaging mechanism which moves the movable sleeve, separating the frangible barrier element (408) and at least a portion of the disengageable constraint (414). As described above, many types of triggering mechanisms and disengaging mechanisms may be used to move the movable sleeve (412), and thereby separate the frangible barrier element (408) at least a portion of the disengageable constraint (414). The listed triggering mechanisms and disengaging mechanisms from above are well known in the prior art.

In particular embodiments, the temporary well isolation device of the present invention may be an integrated part of a Liner Top Packer/Liner Hanger. Alternatively the temporary well isolation device may be configured to be run in the well independently of any other device.

In a typical embodiment, the temporary well isolation device of FIG. 1 also has a pump (not shown) for increasing the fluid pressure in the tubing above the frangible barrier element to rupture the frangible barrier element. Such pumps for increasing fluid pressure in the downhole tubing are well-known to those of skill in the art.

It should be understood that the inventive concepts disclosed herein are capable of many modifications. Such modifications may include modifications in the shape of the housing, the temporary well barrier, and the disengageable constraint; materials used; triggering mechanisms, and disengaging mechanisms. To the extent such modifications fall within the scope of the appended claims and their equivalents, they are intended to be covered by this patent.

What is claimed is:

1. A temporary isolation method for a well isolation device having a frangible barrier element disposed in a passage thereof, the frangible barrier element so disposed as to block fluid flow through the passage, the method comprising:

supporting a load from fluid pressure in the passage by— axially constraining a periphery of the frangible barrier element with an axial force, and radially constraining the periphery of the frangible barrier element with a radial force; and facilitating rupture of the frangible barrier element by the load by— disengaging at least a portion of the radial force from radially constraining the periphery of the frangible barrier element, and changing stress on the frangible barrier element from compressive to tensile.

2. The method of claim 1, further comprising increasing the fluid pressure in the passage on at least one side of the frangible barrier element.

3. The method of claim 1, wherein disengaging the portion of the radial force comprises removing at least a portion of a radial constraint from engaging the periphery of the frangible barrier element.

4. The method of claim 3, wherein removing the radial constraint comprises moving an annular sleeve axially relative to the periphery of the frangible barrier element.

5. The device of claim 1 wherein the frangible barrier element comprises one or more barriers, each of the one or more barriers having a circumferential edge and two sides.

6. The device of claim 1, wherein the frangible barrier element is composed of one or more materials, wherein at least one of the one or more materials withstanding a higher compressive force than a tensile force.

7. A temporary well isolation device, comprising:

a housing deployable downhole and having an axial passage therethrough;

a frangible barrier element disposed within the housing and blocking fluid flow through the axial passage so as to bear a load from fluid pressure;

a first constraint axially constraining a periphery of the frangible barrier element to prevent rupture of the frangible barrier element; and a second constraint radially constraining the periphery of the frangible barrier element to prevent rupture of the frangible barrier element, the second constraint being at least partially disengageable from the periphery of the frangible barrier element and changing stress on the frangible barrier element from compressive to tensile to facilitate rupture of the frangible barrier element.

8. The device of claim 7, wherein an increase of the fluid pressure on one side of the frangible barrier element ruptures the frangible barrier element when the second constraint is at least partially disengageable.

9. The device of claim 7, wherein the frangible barrier element comprises:

a first barrier having a first edge and two sides, the first edge constrained axially by the first constraint and constrained radially by the second constraint.

10. The device of claim 9, wherein the first constraint comprises an annular shoulder facing axially along the passage and axially constraining the first edge, and wherein the second constraint comprises an annular wall facing radially inward to the passage and radially constraining the first edge.

11. The device of claim 9, wherein the frangible barrier element comprises:

a second barrier having a second edge and two sides and disposed adjacent the first barrier, the second edge constrained both axially and radially by a portion of the first constraint.

12. The device of claim 7, further comprising means for moving the frangible barrier element and the second constraint relative to one another.

13. The device of claim 7, wherein the frangible barrier element is composed of one or more materials, wherein at least one of the one or more materials withstanding a higher compressive force than a tensile force.

14. A temporary isolation method for a well isolation device having a frangible barrier element disposed in a passage thereof, the frangible barrier element so disposed as to block fluid flow through the passage, the method comprising:

supporting a load from fluid pressure in the passage by— axially constraining a periphery of the frangible barrier element with an axial force, and radially constraining the periphery of the frangible barrier element with a radial force; and facilitating rupture of the frangible barrier element by the load by— disengaging at least a portion of the axial force from axially constraining the periphery of the frangible barrier element, and changing stress on the frangible barrier element from compressive to tensile.

15. The method of claim 14, further comprising increasing the fluid pressure in the passage on at least one side of the frangible barrier element.

16. The method of claim 14, wherein disengaging the portion of the axial force comprises removing an axial constraint from engaging the periphery of the frangible barrier element.

17. The method of claim 16, wherein removing the axial constraint comprises moving a sleeve and the periphery of the frangible barrier element axially relative to one another.

18. The device of claim 14, wherein the frangible barrier element comprises one or more barriers, each of the one or more barriers having a circumferential edge and two sides.

19. The device of claim 14, wherein the frangible barrier element is composed of one or more materials, wherein at least one of the one or more materials withstanding a higher compressive force than a tensile force.

20. A temporary well isolation device, comprising:

a housing deployable downhole and having an axial passage therethrough;

a frangible barrier element disposed within the housing and blocking fluid flow through the axial passage so as to bear a load from fluid pressure;

a first constraint radially constraining a periphery of the frangible barrier element to prevent rupture of the frangible barrier element; and a second constraint axially constraining the periphery of the frangible barrier element to prevent rupture of the frangible barrier element, the second constraint being at least partially disengageable from the periphery of the frangible barrier element and changing stress on the frangible barrier element from compressive to tensile to facilitate rupture of the frangible barrier element.

21. The device of claim 20, wherein an increase of the fluid pressure on one side of the frangible barrier element ruptures the frangible barrier element when the second constraint is at least partially disengageable.

22. The device of claim 20, wherein the frangible barrier element comprises:

a first barrier having a first edge and two sides, the first edge constrained radially by the first constraint and constrained axially by the second constraint.

23. The device of claim 22, wherein the first constraint comprises an annular wall facing radially inward to the passage and radially constraining the first edge, and wherein the second constraint comprises an annular shoulder facing axially along the passage and axially constraining the first edge.

24. The device of claim 22, wherein the frangible barrier element comprises:

a second barrier having a second edge and two sides and disposed adjacent the first barrier, the second edge constrained both axially and radially by a portion of the first constraint.

25. The device of claim 20, further comprising means for moving the frangible barrier element and the second constraint relative to one another.

26. The device of claim 20, wherein the frangible barrier element is composed of one or more materials, wherein at least one of the one or more materials withstanding a higher compressive force than a tensile force.

* * * * *